United States Patent [19]

Jirard

[11] 4,233,691

[45] Nov. 18, 1980

[54] BEDPAN GUARD

[76] Inventor: Lillian R. Jirard, 107 Wassagussitt Rd., N. Weymouth, Mass. 02191

[21] Appl. No.: 77,172

[22] Filed: Sep. 20, 1979

Related U.S. Application Data

[63] Continuation of Ser. No. 928,895, Jul. 28, 1978, abandoned.

[51] Int. Cl.[3] ..... A61G 9/00; A47K 17/00

[52] U.S. Cl. ..... 4/450

[58] Field of Search ..... 4/1, 111, 112, 113, 4/113.1, 144.1–144.3, 300, 311, 134, 185.5 AB, 185.5 R, 420, DIG. 5; 128/132, 295, 158

[56] References Cited

U.S. PATENT DOCUMENTS

| | | | |
|---|---|---|---|
| 1,499,161 | 6/1924 | Farnsworth | 4/112 |
| 3,153,412 | 10/1964 | Laubsch | 4/144.1 X |
| 3,763,502 | 10/1973 | Laumann | 4/112 |
| 3,777,317 | 12/1973 | Hoborn | 4/112 |
| 3,990,119 | 11/1976 | Barrett | 4/1 |
| 4,048,682 | 9/1977 | Smith | 4/112 X |

FOREIGN PATENT DOCUMENTS

| | | | |
|---|---|---|---|
| 742826 | 1/1956 | United Kingdom | 4/112 |

*Primary Examiner*—Stuart S. Levy

[57] ABSTRACT

A bedpan guard adapted to lie across a portion of the bedpan opening and to be removably attached to the bedpan whereby the male patient's genitalia is supported by the guard and prevented from contacting waste material in the pan and contacting the bottom of the pan. The guard may have a cover attached thereto which can be pulled over the bedpan opening after use.

2 Claims, 3 Drawing Figures

BEDPAN GUARD

This is a Continuation of application Ser. No. 928,895 filed 7/28/78; now abandoned.

BACKGROUND OF THE INVENTION

Due to the fact that modern bedpans are comparatively shallow, in order to lower their center of gravity to assist in achieving patient stability when using the pan, the genitalia of male patients frequently contact the bottom of the pan when he is first seated and are immersed in the waste material following defecation and urination. The shock of contacting the relatively cold bottom of a bedpan will frequently prevent or delay urination to the extreme discomfort of the patient. Immersion of the male genitalia in the waste contained in the pan can lead to skin or urethral infection. There is no present method known to the inventor of preventing such disagreeable contacts of the male patient with the bottom of the pan or the waste contained therein and of preventing the necessity of cleaning the male patient, by medical personnel, after the patient has used the pan causing embarrassment to the patient and taking valuable time from hospital personnel. In order to prevent a used, open bedpan from being transported through hospital corridors to a place of disposal, or leaving a used pan open prior to disposal, covers are utilized. The inventor provides a cover which functions as part of the bedpan guard and can then be pulled over the bedpan opening after use. The problems encountered by the male patient with a regular bedpan are accentuated when a fracture bedpan is used since this type of pan is even shallower than a regular bedpan.

SUMMARY OF THE INVENTION

This invention is directed at a flexible, substantially flat disposable bedpan guard having attachment means such as double or single face adhesive strips or snap fasteners permitting removeable engagement between the guard and bedpan. The body portion of the guard may be of one or two piece construction and if of two piece construction, the upper surface should be of a soft, flexible material such as tissue paper or guaze, while the lower surface may be of a water impermiable material such as PVC. The upper and lower surfaces are adhered or otherwise attached together. The guard is configured to be positioned across the bedpan opening permitting both defecation and urination by the patient. A cover, formed of a soft, flexible material, may be attached at one of its ends to the guard, folded in accordian fashion on the guard and has a free end with a fastener which permits extending the cover over the bedpan opening and fastening it in place.

DESCRIPTION OF THE DRAWINGS

Further details are explained hereinafter with the help of the examples illustrated in the attached drawings in which.

DESCRIPTION OF THE PREFERRED EMBODIMENTS

Figure 1:
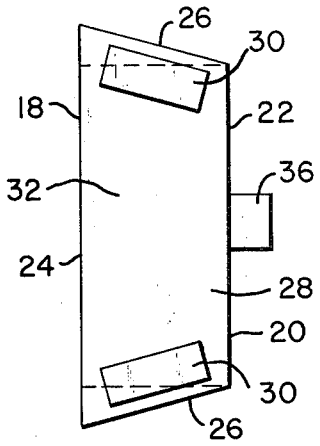
FIG. 1 is a bottom plan view of the bedpan guard according to the present invention.
Figure 2:
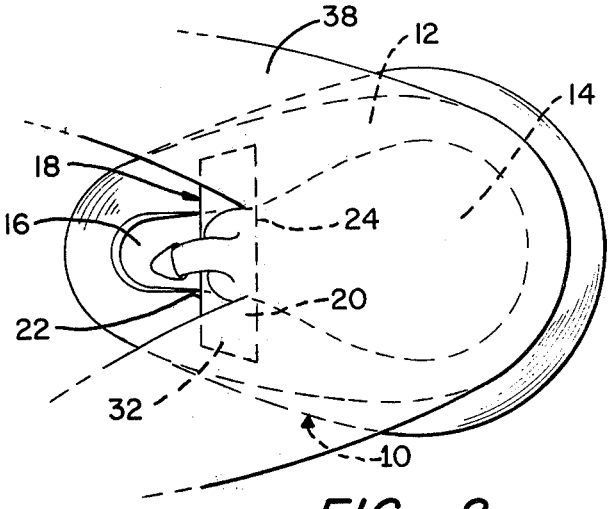
FIG. 2 is a top plan view of the bedpan guard, shown in FIG. 1, attached to a bedpan and indicating a male patient positioned on the bedpan and guard.
Figure 3:
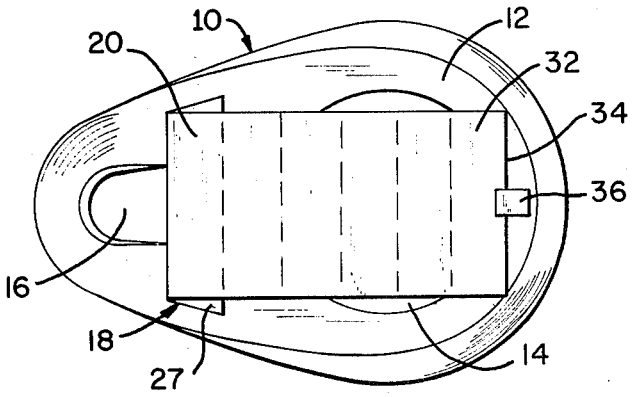
FIG. 3 is a top plan view of the bedpan and guard shown in FIG. 2 with the cover extended and attached to the pan.

Referring to the drawings and more particularly FIG. 2 and FIG. 3, there is shown a bedpan 10 of a generally pear shape made of any suitable material such as stainless steel or polypropylene. The design of the bedpan may also be of any of the various types presently on the market, including the fracture bedpan. The pan 10 includes an upper shoulder 12 that extends inwardly around the inner periphery of the pan 10 and is contoured in a manner that will comfortably support the buttocks of a patient, and which defines a bowling pin-like continuous opening having a back portion 14 and a narrower foward portion 16. The opening communicates with the interior of the pan 10 which provides a basin for accepting and holding human waste. The free edge of the shoulder 12 is concave and slightly sloping downwardly to provide a contoured seat for the individual using the pan 10. It is important to note that most pans are comparatively shallow to reduce the amount of room needed for stacking, storage and to provide stability when in use.

For many years the use of a bedpan by male individuals caused their genital organs to partially rest in the waste. This required that the genitals of the individual be cleaned after every use of the pan. It also presented the danger of skin infection in the genital area, as well as the danger of urethral infection if the head of the penis was located in the waste. Obviously such positioning of the genitalia was extremely uncomfortable for the patient.

To prevent male genitalia from immersion in the waste while a patient is using a bedpan, the inventor has created the disposable bedpan guard 18. The guard comprises a generally rectalinear, flexible, substantially flat body portion 20 (trapazoidal in the embodiment shown) having a forward or first edge 22 and a rear or second edge 24 spaced from and in parallel relation to the forward edge 22. The rear edge 24 is longer than the forward edge 22 for a purpose to be described hereinafter. The forward and rear edges 22, 24 are connected at their ends by side edges 26 so that the guard 18 in top plan view has the configuration of a trapazoid. As can be seen in the drawings, the side edges 26 are angled or biased to somewhat conform to the increased width of the pan 10 from front to back.

The guard 18 is formed of a soft, flexible material or combination of a waterproof material such as thin polyvinal chloride attached to a soft, absorbent material such as guaze or tissue. In the embodiment shown, the upper surface 27 of the guard 18 is a tissue material in supra-abutting relation to the lower surface 28 which is formed of PVC.

The upper surface 27 material may be adhered by a convenient method, such as glueing, to the water impermiable material 28. The water impermiable material 28 can be made longer and wider than the upper surface 27 (i.e. tissue) and its edges folded over the edges of the superposed tissue and adhered in place.

One side of a double faced tape 30 is adhered to the lower surface 28 along and adjacent to each side edge 26. The other adherent surface of the tape 30 is protected by a removeable covering until the guard 18 is ready to be used. The tape can be single faced with the non-adhesive face permanently bonded or adhered to the guard 18. If desired, strips or single faced adherent tape could be attached to the guard 18 extending beyond its side edges to provide a means of adherent engagement between the guard 18 and the bedpan.

The bedpan guard 18 may have other configurations, for example, oval or rectangular, when seen in plan view. In these cases, the strips of double faced tape could be cut or made to conform to the shape of the "side edge" along which they are positioned.

Other means of removeably attaching the bedpan guard 18 to the bedpan could be utilized if desired, for example, by snap fasteners with the sockets positioned on the bedpan and the studs on the bedpan guard.

A cover 32 is attached to the upper surface 27 of the guard 18 adjacent the rear edge 24. The cover 32 is folded in accordian fashion on top of the upper surface, has a width equal to or greater than the rear edge 24, and is formed of a soft, flexible material such as tissue paper. The top layer of the folded cover 32 includes a free end 34 having a double sided tape 36 on its top surface extending beyond the free edge 34 for a purpose to be described hereinafter. The lowest folded layer of the cover 32 is attached by an adhesive or the like to the upper surface 27. The cover 32 is prefolded on the bedpan guard 18 prior to use.

To use the guard 18, the patient 38 is seated on the bedpan 10, the guard is then passed under the scrotum of the patient, rear edge 24 first with the upper surface 27 and the folded cover 32 facing the genitalia. The scrotum is positioned on the cover 32 and the tapes 30 are pressed into adherence with the shoulder 12 of the bedpan 10. In this position, the guard 18 transversely divides the opening of the bedpan leaving a portion of the forward portion 16 available for patient urination and the back portion 14 available for defecation.

If desired, the guard 18 could first be placed on the bedpan 10 in the approximate position shown in FIGS. 2 and 3 and the patient 38 could then seat himself on the pan 10 with his genitalia superposed on the guard 18 and its folded cover 32.

After the patient has used the bedpan 10 and it is removed from under him, the cover 34 is pulled out and over the bedpan opening and the tape 36 is engaged with the bedpan 10. The bedpan 10, with the wastes concealed by the attached cover 32 can now be carried to the waste disposal area where the guard 18 and cover 32 are stripped from the bedpan 10 and thrown away. The contents of the bedpan 10 can now be disposed of and the bedpan 10 can be cleaned in preparation for its next use.

What I claim is:

1. The combination of a bedpan and a bedpan guard, the bedpan comprising a basin, for receiving wastes and a shoulder defining an opening, the opening having a longitudinal axis, the bedpan guard comprising a thin flexible, substantially flat body portion and a cover, the body portion including upper and lower surfaces and attachment means applied to the lower surface wherein the bedpan guard is removeably attached to said bedpan on a plane transverse to the opening of the bedpan and in substantially right angle relation to the longitudinal axis of the bedpan and the cover formed of a soft, foldable material, the cover having an end attached to the upper surface of the body portion, folded in accordian fashion into superposed relation to the upper surface of the bedpan guard, a free terminal end of said cover being adapted when extended to overlay the bedpan opening, and the free terminal end spaced from the end of the cover and having a fastening means engaged thereto, the fastening means engaging the bedpan when the cover is extended to overlay the bedpan opening.

2. A bedpan guard as recited in claim 1 wherein the body portion further comprises the upper surface formed of a soft material and the lower surface formed of a water impermeable material, the upper surface in superposed abutting relationship to the lower surface.

* * * * *